US009079247B2

(12) United States Patent
DiFoggio

(10) Patent No.: US 9,079,247 B2
(45) Date of Patent: Jul. 14, 2015

(54) DOWNHOLE TOOLS INCLUDING ANOMALOUS STRENGTHENING MATERIALS AND RELATED METHODS

(75) Inventor: Rocco DiFoggio, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 563 days.

(21) Appl. No.: 13/295,670

(22) Filed: Nov. 14, 2011

(65) Prior Publication Data

US 2013/0118730 A1 May 16, 2013

(51) Int. Cl.

| | |
|---|---|
| ***C22C 1/04*** | (2006.01) |
| ***B22F 5/10*** | (2006.01) |
| ***E21B 10/54*** | (2006.01) |
| ***B22F 7/08*** | (2006.01) |
| *C22C 18/00* | (2006.01) |
| *C22C 19/00* | (2006.01) |
| *C22C 32/00* | (2006.01) |
| *B22F 5/00* | (2006.01) |

(52) U.S. Cl.

CPC ... *B22F 5/10* (2013.01); *B22F 7/08* (2013.01); *E21B 10/54* (2013.01); *B22F 2005/002* (2013.01); *C22C 18/00* (2015.01); *C22C 19/00* (2013.01); *C22C 32/00* (2013.01); *Y10T 29/49* (2015.01)

(58) Field of Classification Search

USPC ..... 166/244.1, 243; 175/433; 75/315

See application file for complete search history.

(56) References Cited

U.S. PATENT DOCUMENTS

| | | | | |
|---|---|---|---|---|
| 7,658,230 | B2 | 2/2010 | Kimiadi | |
| 7,776,256 | B2 | 8/2010 | Smith et al. | |
| 7,784,550 | B2 | 8/2010 | Nutley et al. | |
| 7,802,495 | B2 | 9/2010 | Oxford et al. | |
| 7,913,779 | B2 | 3/2011 | Choe et al. | |
| 2004/0011559 | A1 | 1/2004 | Harvey et al. | |
| 2004/0140096 | A1 * | 7/2004 | Sandberg et al. | 166/302 |
| 2005/0011395 | A1 * | 1/2005 | Langan et al. | 102/476 |
| 2005/0100756 | A1 * | 5/2005 | Langan et al. | 428/617 |
| 2005/0117984 | A1 * | 6/2005 | Eason et al. | 408/144 |

(Continued)

FOREIGN PATENT DOCUMENTS

| | | | |
|---|---|---|---|
| EP | 351039 | A2 | 1/1990 |
| EP | 521601 | A1 | 1/1993 |
| WO | 2008086284 | A2 | 7/2008 |

OTHER PUBLICATIONS

J. R. Davis, "Guide to Materials Selection, Engineered Materials Handbook Desk Edition", 1995, ASM International, p. 106-154.*

(Continued)

*Primary Examiner* — Cathleen Hutchins

(74) *Attorney, Agent, or Firm* — TraskBritt

(57) ABSTRACT

Downhole tools for use in wellbores in subterranean formations comprise a body comprising at least one anomalous strengthening material. Methods of forming downhole tools for use in wellbores in subterranean formations comprise forming a body comprising at least one anomalous strengthening material. Methods of using downhole tools in wellbores in subterranean formations comprise disposing a body comprising at least one anomalous strengthening material in a wellbore in a subterranean formation. The at least one anomalous strengthening material may be exposed to a temperature within the wellbore higher than a temperature at a surface of the subterranean formation and a yield strength of the at least one anomalous strengthening material may increase.

20 Claims, 8 Drawing Sheets

(56) References Cited

U.S. PATENT DOCUMENTS

| | | | | |
|---|---|---|---|---|
| 2007/0107899 | A1* | 5/2007 | Werner et al. | 166/298 |
| 2010/0071961 | A1 | 3/2010 | Steel et al. | |

OTHER PUBLICATIONS

Bhavsar et al., Corrosion Resistance of UNS N09935 in High Pressure High Temperature Sour Environments, NACE Corrosion Conference & Expo (2011) Paper 11113, pp. 1-14.

Bradley et al., Deep, HP/HT Wells Driving Advances, The American Oil & Gas Reporter, Special Report: Tubulars Technology, Sep. 2005, 5 pages.

Bystrzycki et al., High Strength Nanocrystalline Ni3Al Foil for Military Vehicle Structural Applications, Nato/PFP Unclassified, RTO-MP-AVT-122, pp. 7-1-7-10 (2005).

Fischer, David S., Development of In-Situ Toughened Silicon-Rich Alloys: A New Class of Castable Engineering Ceramics, Submitted to the Department of Materials Science and Engineering in Partial Fulfillment of the Requirements for the Degree of Doctor of Philosophy in Materials Science and Engineering at the Massachusetts Institute of Technology, Sep. 2010, 180 pages.

Foroni et al., High Strength and Corrosion Resistant Superalloys for Oil & Gas, NACE Corrosion Conference & Expo (2011) Paper 11116, pp. 1-18.

Hagihara et al., Indentation Fracture Behavior of (Mo0.85Nb0.15) Si2 Crystals with C40 Single-Phase and MoSi2 (C11b)/NbSi2(C40) Duplex-Phase with Oriented Lamellae, Scient and Technology of Advanced Materials, vol. 5, pp. 11-17 (2004).

Lee et al., High Temperature Load Relaxation Behavior of ¬β -Brass Alloy, 30 Proceedings of the 3rd Pacific Rim Int'l Conf. on Adv. Mat. & Processing, pp. 2997-3002 (1998).

Ramesh et al., Crystal Structure Changes in Ni3Al and its Anomalous Temperature Dependence of Strength, 56 Journal of Materials Processing Technology, pp. 78-87 (1996).

Yoo et al., Micromechanisms of Deformation and Fracture in Ordered Intermetallic Alloys—I. Strengthening Mechanisms, DOI 10.2172/6958118, 62 pages (1988).

Park, Jong-Woo, Anomalous Yield Behavior of Hypo- and Hyper-Stoichiometric Fe3Al Intermetallic Compounds, Intermetallics, Jul. 2002, vol. 10, No. 7, pp. 683-691.

International Search Report for International Application No. PCT/US2012/063850 dated Mar. 27, 2013, 3 pages.

International Written Opinion for International Application No. PCT/US2012/063850 dated Mar. 27, 2013, 6 pages.

International Preliminary Report on Patentability for International Application No. PCT/US2012/063850 dated May 20, 2014, 7 pages.

* cited by examiner

DOWNHOLE TOOLS INCLUDING ANOMALOUS STRENGTHENING MATERIALS AND RELATED METHODS

FIELD

The disclosure relates generally to downhole tools for use in the formation and exploration of wellbores in subterranean formations. More specifically, disclosed embodiments relate to downhole tools at least partially formed from at least one anomalous strengthening material.

BACKGROUND

Generally, downhole tools used in the formation of boreholes (e.g., wellbores) in subterranean formations are subjected to elevated temperatures and pressures. For example, downhole tools used in water, oil, and gas wellbore formation are subjected to temperatures that frequently exceed 100° C. Downhole tools used in geothermal wellbore formation can be subjected to temperatures reaching 350° C. and greater. The strength of materials generally decreases with increasing temperature. Thus, downhole tools may be damaged and may even experience catastrophic failure due, at least in part, to the weakening of the materials of the downhole tools with increased temperatures.

This temperature-induced weakening of materials in the downhole environment may require the use of costly materials that are difficult to manufacture and manipulate to ensure that the downhole tool including that material retains sufficient strength to operate even when subjected to high temperatures and pressures that weaken the material. In addition, temperature-induced weakening of materials may require a downhole tool operator to reduce the power acting on the downhole tool to prolong its life (i.e., to derate the downhole tool). For example, an operator may decrease weight-on-bit (WOB), torque on a drill string, speed of rotation of an earth-boring drill bit, or any combination of these as greater depths expose the earth-boring drill bit and components of the drill string to ever increasing temperatures and pressures. Wireline tools, which are lowered into a well on a wireline after drilling are used to determine characteristics of earth formations in the well. Such wireline tools may comprise a hollow, tubular pressure housing containing sensors and their electronics. With increasing temperatures, the highest pressure rating of these tools is reduced to avoid a possible collapse of the pressure housing and corresponding catastrophic tool failure. Any of the foregoing deratings of downhole tools may prolong the useful lives of the downhole tools despite temperature-induced weakening of the materials included in the downhole tools, but may also reduce a rate at which the downhole tools perform their tasks (e.g., reduce rate of penetration for an earth-boring drill bit), cause the downhole tool to perform abnormally, or reduce the maximum pressure at which the tool can be operated.

BRIEF SUMMARY

In some embodiments, downhole tools for use in wellbores in subterranean formations comprise a body comprising at least one anomalous strengthening material. The at least one anomalous strengthening material may optionally exhibit increasing yield strength with increasing temperature over at least some temperatures within a range of temperatures extending from about 0° C. to about 500° C.

In other embodiments, methods of forming downhole tools for use in wellbores in subterranean formations comprise forming a body comprising at least one anomalous strengthening material.

In still other embodiments, methods of using downhole tools in wellbores in subterranean formations comprise disposing a body comprising at least one anomalous strengthening material in a wellbore in a subterranean formation. The at least one anomalous strengthening material may be exposed to a temperature within the wellbore higher than a temperature at a surface of the subterranean formation and a yield strength of the at least one anomalous strengthening material may increase.

BRIEF DESCRIPTION OF THE DRAWINGS

While the specification concludes with claims particularly pointing out and distinctly claiming what are regarded as embodiments of the invention, various features and advantages of disclosed embodiments may be more readily ascertained from the following description when read in conjunction with the accompanying drawings, in which:

DETAILED DESCRIPTION

The illustrations presented herein are not meant to be actual views of any particular downhole tool, component, or material thereof, but are merely idealized representations employed to describe illustrative embodiments. Thus, the drawings are not necessarily to scale. Additionally, elements common between figures may retain the same or similar numerical designation.

Disclosed embodiments relate generally to downhole tools at least partially formed from at least one anomalous strengthening material. More specifically, disclosed are downhole tools for use in the formation or exploration of subterranean wellbores that are at least partially formed from at least one anomalous strengthening material.

As used herein, the term "anomalous strengthening material" means and includes any material that exhibits increasing yield strength with increasing temperature over at least some temperatures within the range of temperatures extending from about 0° C. to about 500° C. As known in the art, the yield strength of a material is the stress within the material at which the material begins to permanently deform (i.e., experience plastic deformation).

The term "downhole tool," as used herein, means and includes any type of tool used in the formation or exploration of a wellbore in a subterranean formation. For example, downhole tools include fixed-cutter bits, rolling cone bits, impregnated bits, core bits, eccentric bits, bicenter bits, hybrid bits, reamers, mills, pressure housings, centralizers, stabilizers, casing sections, drill pipe, component connectors in a tubular string, such as, for example, a drill string, a casing string, a geothermal pipe casing, open hole and cased hole logging tools, wireline tools, and other tools for use in wellbores as known in the art.

Figure 1:
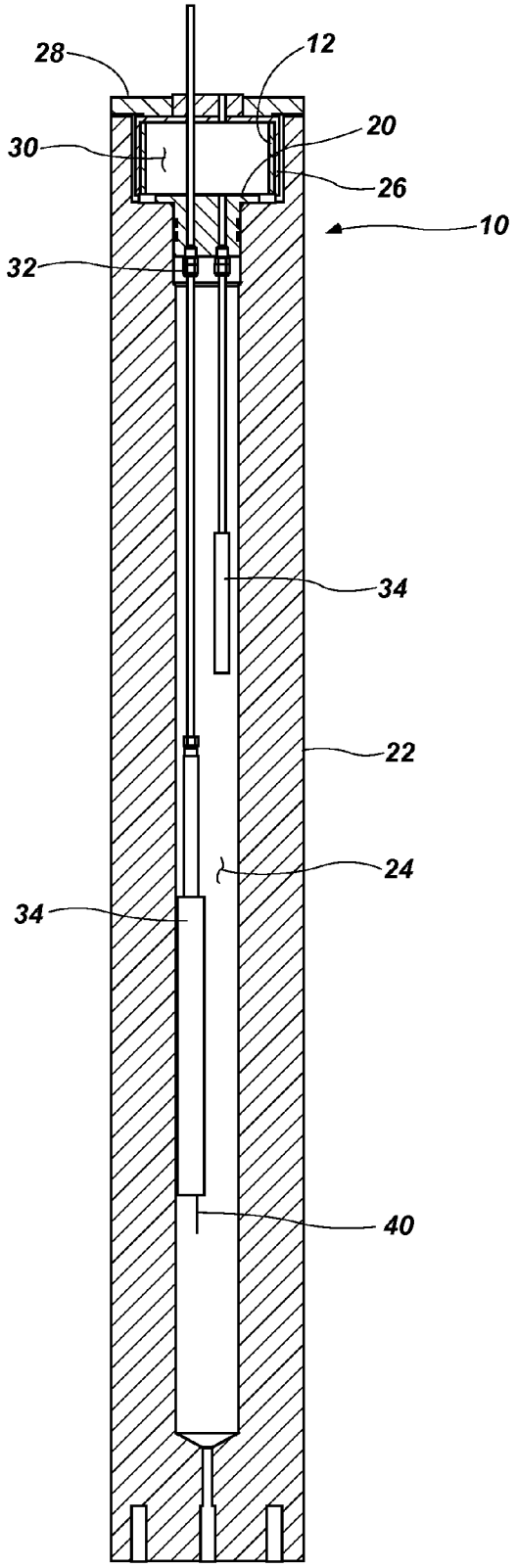
FIG. 1 is a cross-sectional view of a downhole tool for use in a wellbore in a subterranean formation.

Referring to FIG. 1, a cross-sectional view of a downhole tool 10 for use in a wellbore in a subterranean formation is shown. The downhole tool 10 comprises a body 12 at least partially formed from at least one anomalous strengthening material.

The range of temperatures over which the yield strength of the anomalous strengthening material increases with increasing temperature may at least partially overlap a range of temperatures expected to be encountered within the wellbore, and may encompass the range of temperatures expected to be encountered within the wellbore in some embodiments. Accordingly, the anomalous strengthening material may increase in yield strength as the downhole tool 10 encounters increasing temperatures within the wellbore because the increased temperatures may not reach levels that would decrease the yield strength of the anomalous strengthening material in such embodiments. For example, a range of temperatures expected to be encountered within the wellbore may be between about 100° C. and 350° C., and the anomalous strengthening material selected may increase in yield strength over a range of temperatures extending from 100° C. or less to 350° C. or more. More specifically, the range of temperatures expected to be encountered within the wellbore may be between about 110° C. and 200° C., and the anomalous strengthening material selected may increase in yield strength over a range of temperatures extending from 110° C. or less to 200° C. or more. Still more specifically, the range of temperatures expected to be encountered within the wellbore may be between about 120° C. and 150° C., and the anomalous strengthening material selected may increase in yield strength over a range of temperatures extending from 120° C. or less to 150° C. or more. In other embodiments, the range of temperatures over which the yield strength of the anomalous strengthening material increases with increasing temperature may be less than a range of temperatures expected to be encountered within the wellbore.

Strengthening (i.e., increase in the yield strength) of the anomalous strengthening material may be due at least in part to the interaction of different elements or phases in the anomalous strengthening material. For example, the anomalous strengthening material may comprise an alloy of at least two different elemental constituents. In other words, at least two different elements may be homogeneously mixed or in metallic solid solution with one another to form the anomalous strengthening material. At least one element of the alloy may have a different natural crystalline structure (e.g., simple cubic, body-centered cubic (BCC), face-centered cubic (FCC), etc.) from a natural crystalline structure of another element of the alloy. With increasing temperature within a range of temperatures, the anomalous strengthening material may begin transitioning from one of the natural crystalline structures to the other of the natural crystalline structures. This transitioning between crystalline structuring may cause atomic dislocations that impede deformation and distortion of the anomalous strengthening material. Thus, exposing the anomalous strengthening material to increasing temperatures within the range of temperatures may correspondingly increase the yield strength of the anomalous strengthening material.

The anomalous strengthening material may comprise any material that increases in yield strength with increasing temperatures over at least a range of temperatures. For example, the anomalous strengthening material may comprise $Ni_3Al$, $Ni_3V$, $Ni_3Ga$, $Ni_3Si$, $Ni_3Ge$, $Fe_3Al$, FeAl, $Fe_3Ga$, $Fe_3V$, FeCo, $Fe_3Be$, β-CuZn, $Cu_3Au$, $Co_3Ti$, $Co_3V$, $Pt_3Ti$, $Ag_2MgZn$, TiAl, $Mg_3Cd$, $Mn_3Sn$, or a refractory metal disilicide. An example of a $Ni_3Al$ material that exhibits anomalous strengthening with increasing temperature over a range of temperatures is disclosed in R. Ramesh, B. Pathiraj, and B. H. Kolster, *Crystal Structure Changes in* $Ni_3$ Al and its Anomalous Temperature Dependence of Strength, 56 Journal of Materials Processing Technology 78 (1996), the disclosure of which is incorporated herein in its entirety by this reference. Additional examples of anomalous strengthening materials and their behaviors are disclosed in M. H. Yoo, J. A. Horton, and C. T. Liu, *Micromechanisms of Deformation and Fracture in Ordered Intermetallic Alloys—I. Strengthening Mechanisms*, DOI 10.2172/6958118 (1988), the disclosure of which is incorporated herein in its entirety by this reference.

Figure 2:
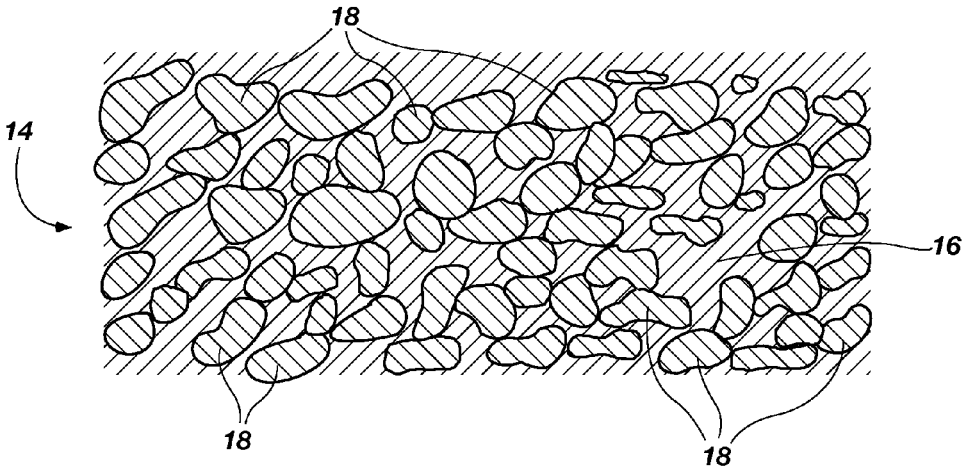
FIG. 2 is a schematic cross-sectional view of a composite material including an anomalous strengthening material and a temperature weakening material.

As a specific, non-limiting example, the anomalous strengthening material may comprise a β-CuZn alloy with a B2 ordered structure, also known in the art as an "interpenetrating simple cubic structure" or a "cesium chloride structure." Such a B2 ordered structure may comprise atoms of Cu in a simple cubic lattice and atoms of Zn in a simple cubic lattice, where the simple cubic lattices of the Cu and the Zn overlap one another such that an atom of Zn is located at the center of each cube of the Cu simple cubic lattice and an atom of Cu is located at the center of each cube of the Zn simple cubic lattice. The β-CuZn may comprise 52% by weight Cu and 48% by weight Zn. As shown in FIG. 2 in Kee Aim Lee, Young Won Chang, and Chong Soo Lee, *High Temperature Load Relaxation Behavior of β-Brass Alloy,* 30 Proceedings of the 3rd Pacific Rim Int'l Conf. on Adv. Mat. & Processing 2997 (1998), the disclosure of which is incorporated herein in its entirety by this reference, the yield strength of such a β-CuZn alloy may increase over at least some temperatures within the range of about 150° C. and about 325° C., depending on strain rate.

The body 12 may be partially formed from a temperature weakening material (i.e., a material that only decreases in yield strength with increasing temperature) in addition to the anomalous strengthening material in some embodiments. In this way, the material of the body 12 may be tailored to exhibit a selected and predetermined yield strength behavior with increasing temperature over a range of temperatures. For example, the yield strength of the body 12 may increase with increasing temperature at a selected rate different from (e.g., slower than) a rate at which the yield strength of the body 12 would increase if it were formed only from the anomalous strengthening material. As another example, the yield strength of the body 12 may be at least substantially constant with increasing temperature. As yet another example, the yield strength of the body 12 may decrease with increasing temperature at a selected rate different from (e.g., slower than) a rate at which the yield strength of the body 12 would decrease if it were formed only from the temperature weakening material.

For example, and with reference to FIG. 2, a cross-sectional view of a composite material 14 that may be used to form a body 12 formed from at least one anomalous strengthening material 16 and at least one temperature weakening material 18 is shown. The composite material 14 may include regions of anomalous strengthening material 16 that abut regions of temperature weakening material 18. For example, the composite material 14 may comprise a discontinuous phase (e.g., particles) of the temperature weakening material 18. The particles of temperature weakening material 18 may be interspersed among a continuous matrix phase of the anomalous strengthening material 16. The composite material 14 may have an at least substantially constant yield strength over a range of temperatures because of the combined strengthening of the anomalous strengthening material 16 and weakening of the temperature weakening material 18.

For example, the quantity of temperature weakening material 18 in the composite material 14 and the rate at which the temperature weakening material 18 decreases in yield strength with increasing temperature over the range of temperatures combined with the quantity of anomalous strengthening material 16 in the composite material 14 and the rate at which the anomalous strengthening material 16 increases in yield strength with increasing temperature over the range of temperatures may render the resulting composite material 14 at least substantially constant in yield strength over the range of temperatures. This dependence of the resulting material properties of the composite material 14 on the material properties and quantities of the anomalous strengthening material 16 and the temperature weakening material 18 in the composite material 14 is governed by the "Rule of Mixtures." The Rule of Mixtures for such a particle-matrix composite material 14 provides that the material property of the composite material 14 equals the material property of the anomalous strengthening material 16 multiplied by the volume fraction of the anomalous strengthening material 16 plus the material property of the temperature weakening material 18 multiplied by the volume fraction of the temperature weakening material 18. Expressed symbolically, the Rule of Mixtures provides that $YS_C = YS_{ASM}V_{ASM} + YS_{TWM}V_{TWM}$, where $YS_C$ is the yield strength of the composite material 14, $YS_{ASM}$ is the yield strength of the anomalous strengthening material 16, $V_{ASM}$ is the volume fraction of the anomalous strengthening material 16, $YS_{TWM}$ is the yield strength of the temperature weakening material 18, and $V_{TWM}$ is the volume fraction of the temperature weakening material 18. As a specific, non-limiting example, the temperature weakening material 18 and the anomalous strengthening material 16 may be present in equal quantities in the composite material 14 and the temperature weakening material 18 may decrease in yield strength at the same rate as the anomalous strengthening material 16 increases in yield strength with increasing temperature over the range of temperatures to render the composite material 14 at least substantially constant in yield strength over the range of temperatures.

In other embodiments, the anomalous strengthening material 16 and the temperature weakening material 18 may be combined into a composite material where the temperature weakening material 18 forms the matrix and the anomalous strengthening material 16 forms the particles. In still other embodiments, the anomalous strengthening material 16 and the temperature weakening material 18 may be combined into a composite material having a non-constant yield strength (e.g., increasing or decreasing yield strength) with increasing temperatures over the range of temperatures. In still other embodiments, the anomalous strengthening material 16 and the temperature weakening material 18 may be combined through alloying (i.e., homogeneous mixing or in metallic solid solution with one another) or through mechanical affixation (e.g., by welding, interference fit, adhesion, etc.) of distinct portions of the body 12 formed of the anomalous strengthening material 16 and the temperature weakening material 18 to one another.

Figure 2A:
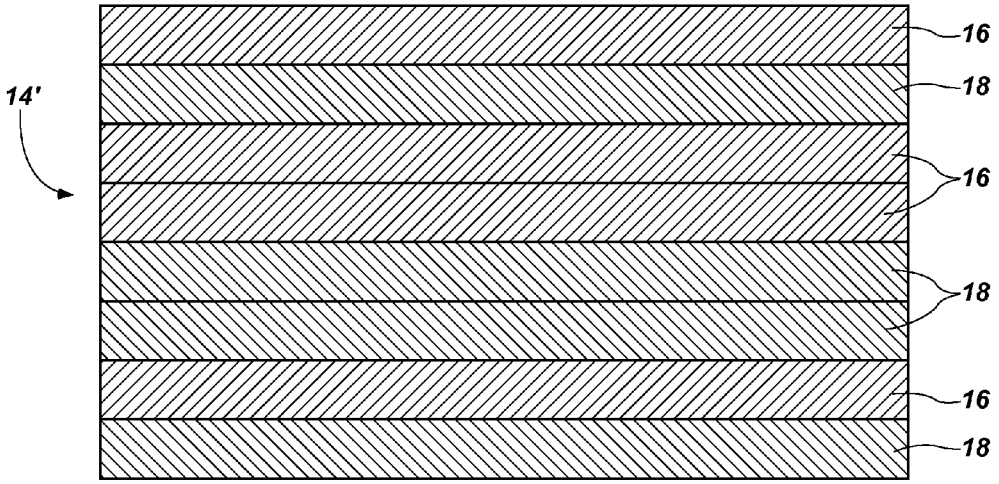
FIG. 2A is a schematic cross-sectional view of another embodiment of a composite material.

Referring to FIG. 2A, a cross-sectional view of another embodiment of a composite material 14' that may be used to form a body 12 comprising at least one anomalous strengthening material 16 and at least one temperature weakening material 18 is shown. The composite material 14' may include regions of anomalous strengthening material 16 that abut regions of temperature weakening material 18. For example, the composite material 14' may include at least one layer of anomalous strengthening material 16 abutting at least another layer of temperature weakening material 18. The layers of anomalous strengthening material 16 and temperature weakening material 18 may alternate with one another. For example, at least one layer of anomalous strengthening material 16 may be interposed between two layers of temperature weakening material 18. Likewise, at least one layer of temperature weakening material 18 may be interposed between two layers of anomalous strengthening material 16. In some embodiments, not all the layers may alternate. For example, at least one layer of anomalous strengthening material 16 may be interposed between another layer of anomalous strengthening material 16 and a layer of temperature weakening material 18. Likewise, at least one layer of temperature weakening material 18 may be interposed between another layer of temperature weakening material 18 and a layer of anomalous strengthening material 16. In alternative embodiments, the regions of anomalous strengthening material 16 and temperature weakening material 18 may have non-planar interfaces between the regions, may be of varying thicknesses, and may have various shapes.

Returning to FIG. 1, forming the body 12 at least partially from at least one anomalous strengthening material 16 may enable the body 12 to be used in a wellbore in a subterranean formation without derating because the anomalous strengthening material 16 may not experience a decrease in yield strength or may experience a decrease in yield strength to a lesser degree than bodies not including such anomalous strengthening materials. Thus, the anomalous strengthening material 16 may enable the downhole tool 10 to be used in deeper wellbores, which may expose the downhole tool 10 to higher pressures and temperatures, and in otherwise higher temperature conditions than similar downhole tools lacking such anomalous strengthening materials. In addition, the anomalous strengthening material 16 may enable more predictable performance of the downhole tool 10 through custom tailoring of the yield strength at least within a range of temperatures as described previously.

The body 12 may comprise, for example, a hollow cylindrical sleeve configured to reinforce another component or other components of the downhole tool 10. For example, such a hollow tubular sleeve comprising an analomous strengthening material could be placed inside or outside of a pressure housing sleeve to increase its strength at elevated temperatures. The downhole tool 10 may comprise a monitoring system that may be run into a wellbore by wireline or, alternatively, incorporated into a side pocket mandrel or a production string, or disposed into a wellbore according to other methods known in the art. A similar monitoring system is disclosed in greater detail in U.S. Pat. No. 7,658,230 B2, issued Feb. 9, 2010, to Kimiadi, the disclosure of which is incorporated herein in its entirety by this reference. Such a downhole tool 10 may include a pressure-resistant bulkhead 20 and an outer protective pressure-resistant enclosure 22 defining a central chamber 24. A pressure-resistant housing 26 is located within the enclosure 22 proximate the upper end of the enclosure 22 and closed off by gland nut 28. In the depicted embodiment, the housing 26 is generally cylindrically-shaped and defines an interior enclosure 30. However, other suitable shapes may be used. An interface fitting 32 is affixed to the lower end of the bulkhead 20. Extending downwardly from the interface fitting 32 within the chamber 24 is a number of sensors 34 (e.g., temperature and pressure sensors). A fluid communication port 40 extends through the enclosure 22 to permit fluid within a surrounding wellbore to enter the chamber 24 and be communicated to the sensors 34.

Figure 3:
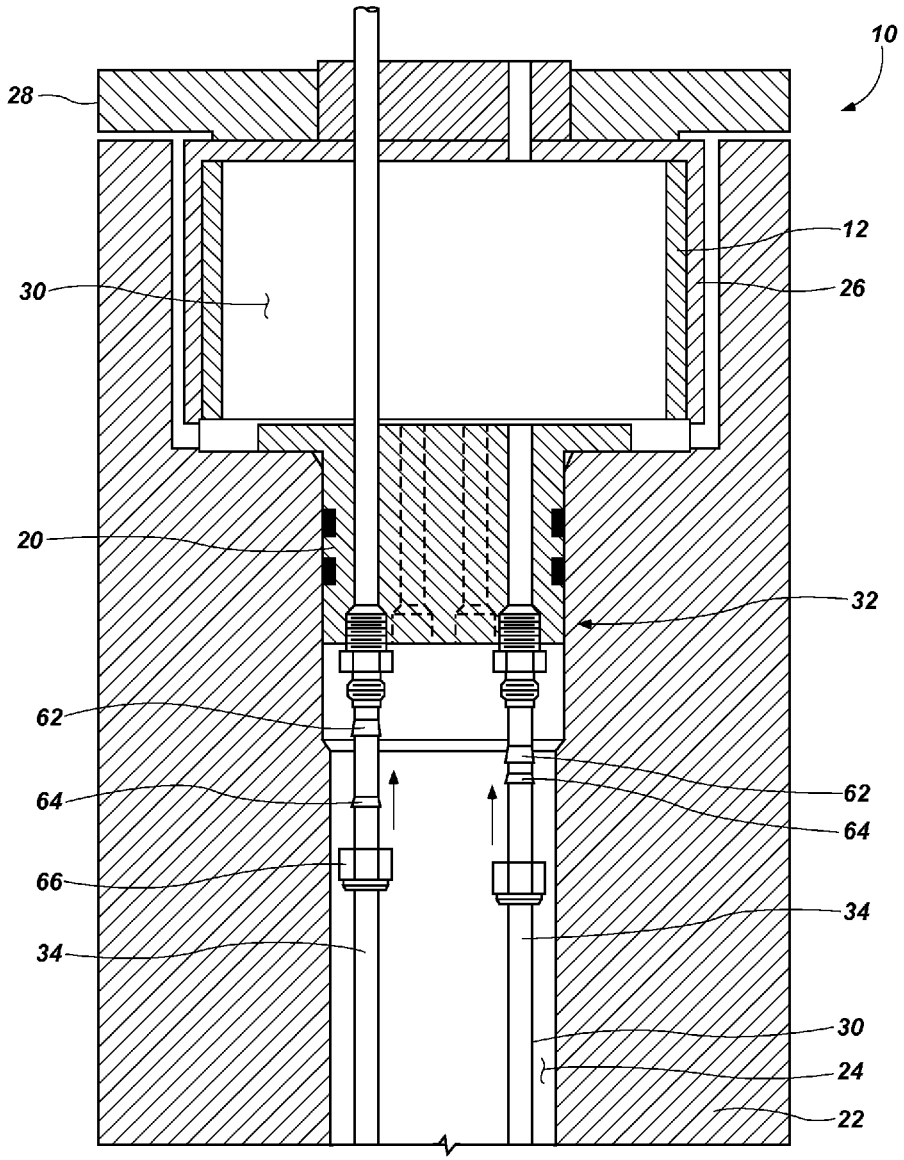
FIG. 3 is an enlarged cross-sectional view of a portion of the downhole tool of FIG. 1.

FIG. 3 illustrates a portion of the downhole tool 10 in greater detail. The interface fitting 32 is used to communicate the sensors 34 within the chamber 24 through the pressure-resistant bulkhead 20 to an exterior of the downhole tool 10. The interface fitting 32 provides a hermetically-sealed feed-through device for the sensors 34. The chamber 24 is exposed to hydrostatic pressure, and therefore, the bulkhead 20 is exposed to high pressure upon its lower side but not its upper side. Accordingly, the bulkhead 20 may press against the housing 26 and the body 12. As the downhole tool 10 is exposed to increased temperatures in a subterranean wellbore, components of the downhole tool 10 formed from temperature weakening materials (e.g., the housing 26) may weaken. In addition, the high pressures in the downhole environment may cause the bulkhead 20 to press against the housing 26. The body 12 may reinforce the housing 26, especially when the body 12 and the housing 26 are exposed to temperatures within the range of temperatures over which the anomalous strengthening material of the body 12 increases in yield strength with increasing temperature. Thus, the anomalous strengthening material may enable the downhole tool 10 to be used in environments where the downhole tool 10 is exposed to higher temperatures and higher pressures than a similar downhole tool lacking such anomalous strengthening material.

In other embodiments, other components of the downhole tool 10 may be at least partially formed from an anomalous strengthening material. For example, one, some, or all of the housing 26, the bulkhead 20, the enclosure 22, and the gland nut 28 may be partially or completely formed from anomalous strengthening material. In such embodiments, the reinforcing body 12 may optionally be omitted from the downhole tool 10.

Figure 4:
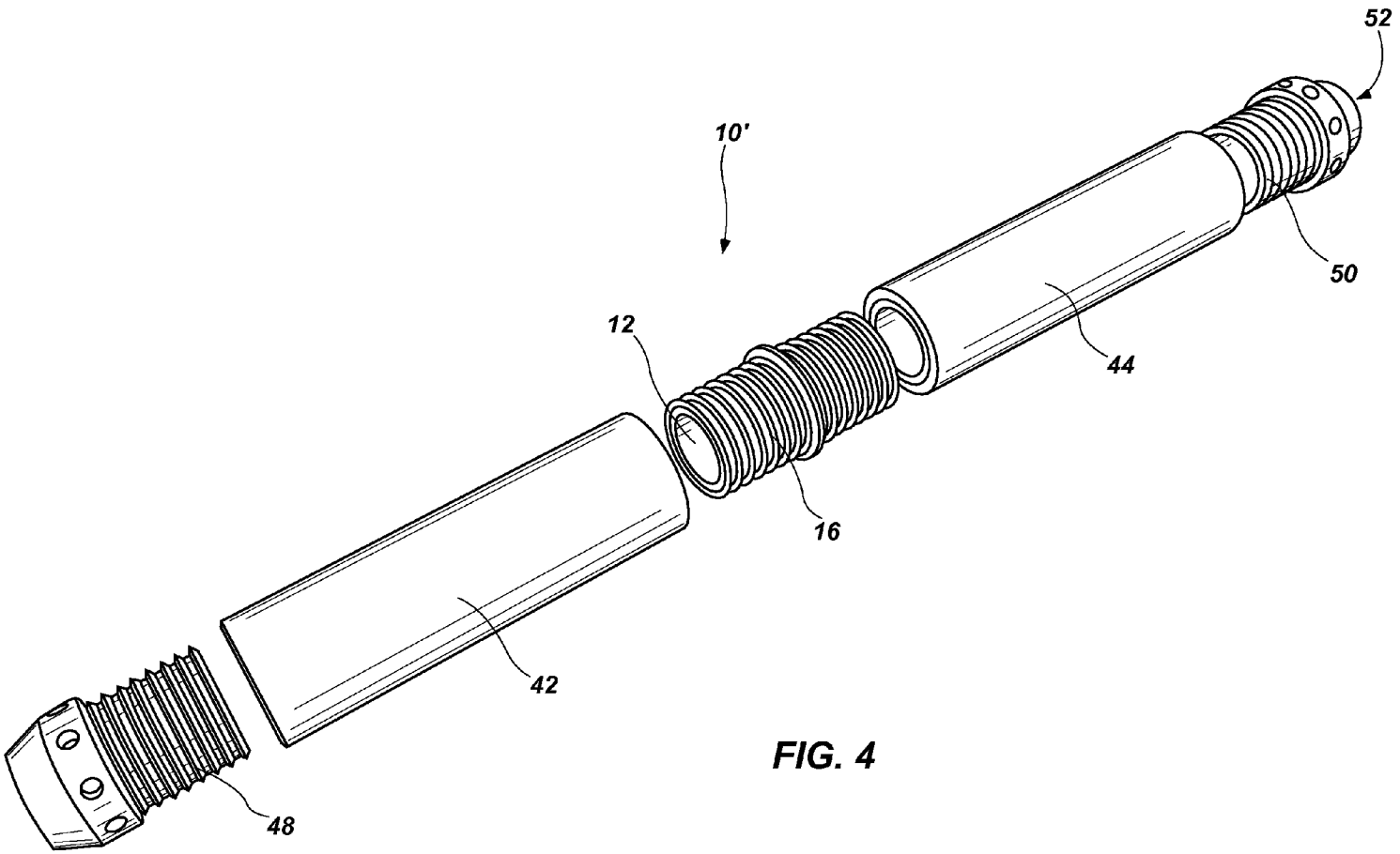
FIG. 4 is an exploded perspective view of a another embodiment of a downhole tool for use in a wellbore in a subterranean formation.

Referring to FIG. 4, an exploded perspective view of another embodiment of a downhole tool 10' for use in a wellbore in a subterranean formation is shown, at least one component of which includes an anomalous strengthening material as disclosed in further detail below. The downhole tool 10' may comprise a tubular assembly for use in a wellbore, such as, for example, a string of drill pipe, a casing string, or other series of tubular members interconnected to form a string. A similar tubular member is disclosed in more detail in U.S. Pat. No. 7,784,550 B2, issued Aug. 31, 2010, to Nutley et al., the disclosure of which is incorporated herein in its entirety by this reference. The downhole tool 10' may include a first tubular member 42, a second tubular member 44, a connector 46, a first end connector 48 and a second end connector 50. The connector 46 is configured to connect the two tubular members 42 and 44 together. Though a single connector 46 is shown as connecting two tubular members 42 and 44 between the end connectors 48 and 50, a plurality of connectors 46 may connect a greater number of tubular members 42 and 44 between the end connectors 48 and 50 in some embodiments. Each of the first and second tubular members 42 and 44, the first and second end connectors 48 and 50, and the connector 46 are generally cylindrical in shape and cooperatively define a bore 52 extending longitudinally through the downhole tool 10'.

The connector 46 is of generally cylindrical shape and partially defines the bore 52. The connector 46 has ridged profiles (e.g., mating threads) at respective opposing ends of the connector 46. The ridged profiles of the connector 46 may matingly engage with corresponding ridged profiles on the first and second tubular members 48 and 50. The ridged profiles of the connector 46 may be disposed on the exterior of the connector and the ridged profiles of the first and second tubular members 48 and 50 may be disposed on the interior of the first and second tubular members 48 and 50, as shown in FIG. 4. In other embodiments, the ridged profiles of the connector 46 may be disposed on the interior of the connector and the ridged profiles of the first and second tubular members 48 and 50 may be disposed on the exterior of the first and second tubular members 48 and 50.

Figure 5:
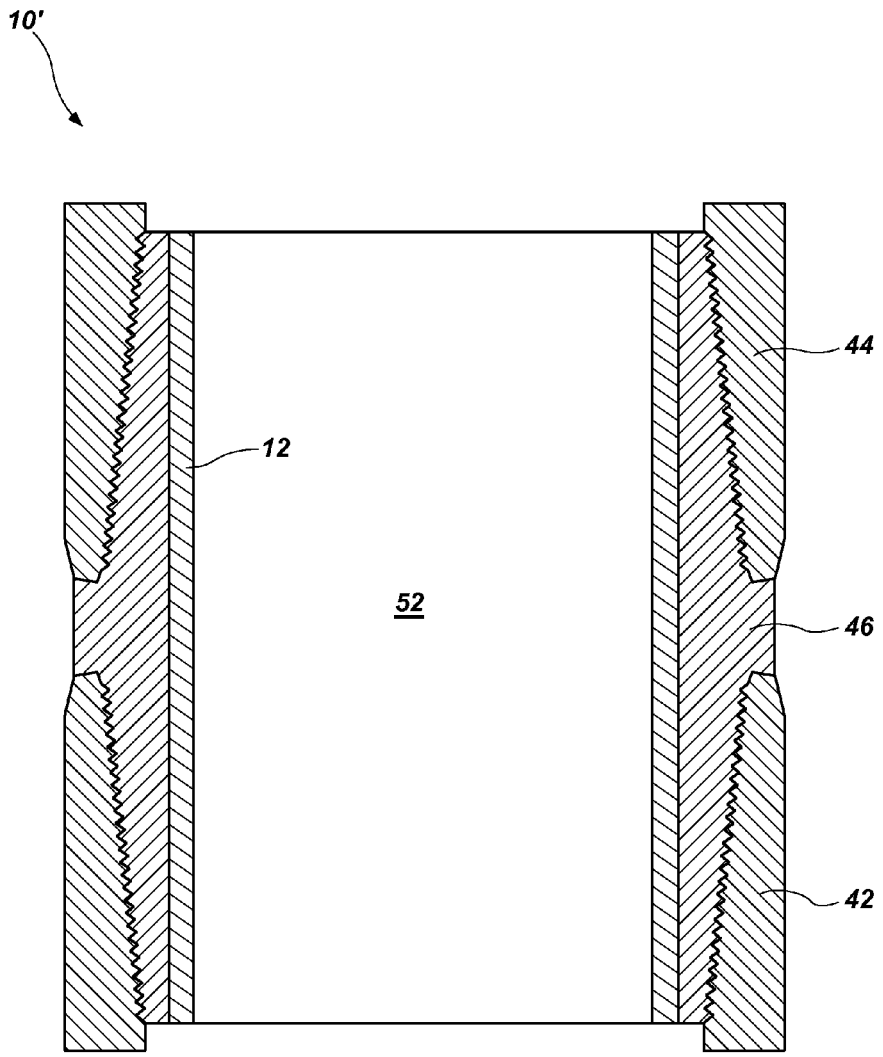
FIG. 5 is a cross-sectional view of a portion of the assembled downhole tool of FIG. 4.

Referring to FIG. 5, a cross-sectional view of a portion of the assembled downhole tool 10' of FIG. 4 is shown. The body 12 may comprise a hollow cylindrical sleeve attached to and disposed within the connector 46, as shown in FIG. 4. In other embodiments, the body 12 may comprise a hollow cylindrical sleeve attached to and surrounding the connector 46. Thus, the body 12 may be configured to reinforce the connector 46. The body 12 may be at least partially formed from an anomalous strengthening material. In this way, the body 12 may provide increased reinforcement to the connector 46 as the downhole tool 10', including the body 12 and the connector 46, is exposed to increased temperatures within a wellbore in a subterranean formation as compared to a similar downhole tool lacking such an anomalous strengthening material.

In some embodiments, the downhole tool 10' may transmit torque and weight-on-bit (WOB) to another component in a drill string (e.g., an earth-boring drill bit, a reamer, a mill, etc.). In such embodiments, the anomalous strengthening material of the body 12 may enable the downhole tool 10' to be used without derating (i.e., reducing the rated maximum torque or WOB) at high temperatures that may otherwise require derating in a similar downhole tool lacking such an anomalous strengthening material.

In alternative embodiments, the body 12 may be disposed within or may surround one, some, or all of the first tubular member 42, the second tubular member 44, the first end connector 48, and the second end connector 50. In some embodiments, other components of the downhole tool 10' may be at least partially formed from an anomalous strengthening material. For example, one, some, or all of the first tubular member 42, the second tubular member 44, the first end connector 48, and the second end connector 50 may be partially or completely formed from an anomalous strengthening material. In such embodiments, the reinforcing body 12 may optionally be omitted from the downhole tool 10'.

Figure 6:
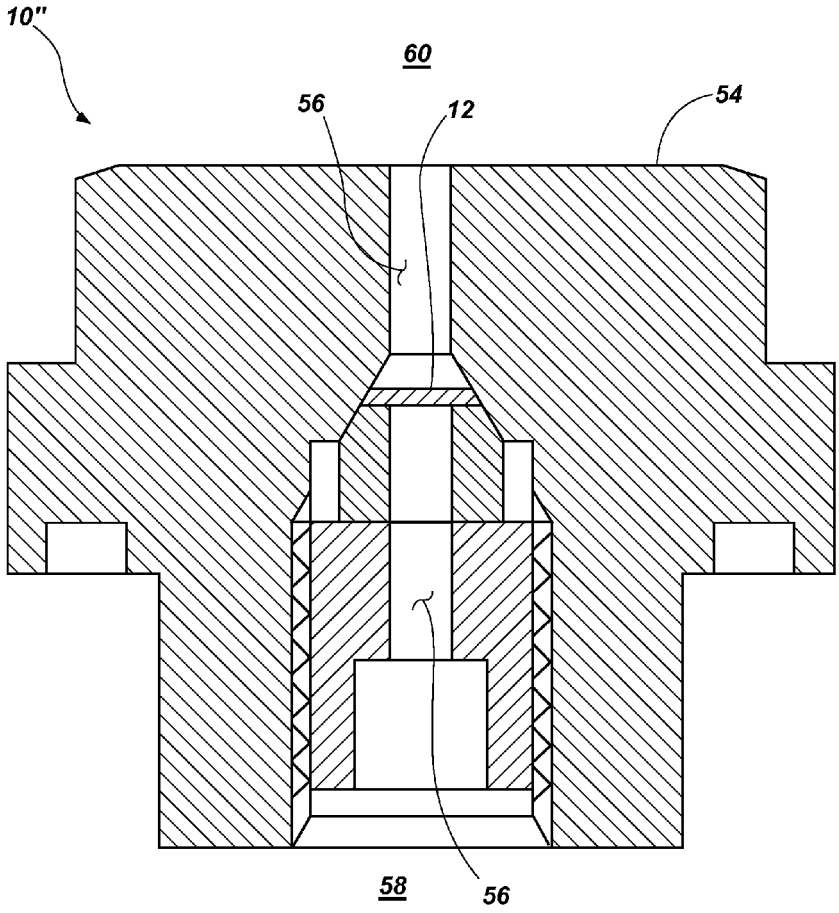
FIG. 6 is a cross-sectional view of another embodiment of a downhole tool for use in a wellbore in a subterranean formation.

Referring to FIG. 6, a cross-sectional view of another embodiment of a downhole tool 10" for use in a wellbore in a subterranean formation is shown, which includes at least one component comprising an anomalous strengthening material. The downhole tool 10" may comprise a safety valve for use in a wellbore. A similar safety valve for use in a wellbore is disclosed in more detail in U.S. Patent Application Pub. No. 2004/0011559 A1, published Jan. 22, 2004, to Harvey et al., the disclosure of which is incorporated herein in its entirety by this reference. The downhole tool 10" may comprise a cap 54 and a passage 56 extending through the cap 54 from a high pressure region 58 to a low pressure region 60. A body 12 at least partially formed from anomalous strengthening material may separate the high pressure region 58 from the low pressure region 60. The body 12 may be configured as a burst plate, which may rupture when a difference in pressure between the high pressure region 58 and the low pressure region 60 exceeds a selected and predefined maximum stress for the body 12.

In some embodiments, the body 12 configured as a burst plate may be partially formed from a temperature weakening material such that a yield stress of the body 12 is at least substantially constant over a range of temperatures because of the combined strengthening of the anomalous strengthening material and weakening of the temperature weakening material with increased temperature within the range of temperatures. For example, the body 12 may be formed from a composite material including regions (e.g., particles or layers) of the temperature weakening material abutting regions (e.g., matrix or layers) of the anomalous strengthening material. In this way, the body 12 may rupture at a selected pressure differential between the high pressure region 58 and the low pressure region 60 irrespective of temperature difference, so long as the temperature remains in the range of temperatures over which the yield stress of the body 12 remains at least substantially constant. Accordingly, the anomalous strengthening material may enable more consistent and predictable performance of the safety valve as compare to a similar safety valve lacking such an anomalous strengthening material. In other embodiments, the body 12 may be formed entirely from the anomalous strengthening material or the body 12 may be formed from both an anomalous strengthening material and a temperature weakening material in such a way that the body 12 increases or decreases in yield strength at a different rate over the range of temperatures than a similar body lacking such an anomalous strengthening material.

In some embodiments, other components of the downhole tool 10" may be at least partially formed from an anomalous strengthening material. For example, the cap 54, other components defining the passage 56, or other components defining portions of or disposed within the high pressure region 58 or the low pressure region 60 may be at least partially formed from an anomalous strengthening material.

Figure 7:
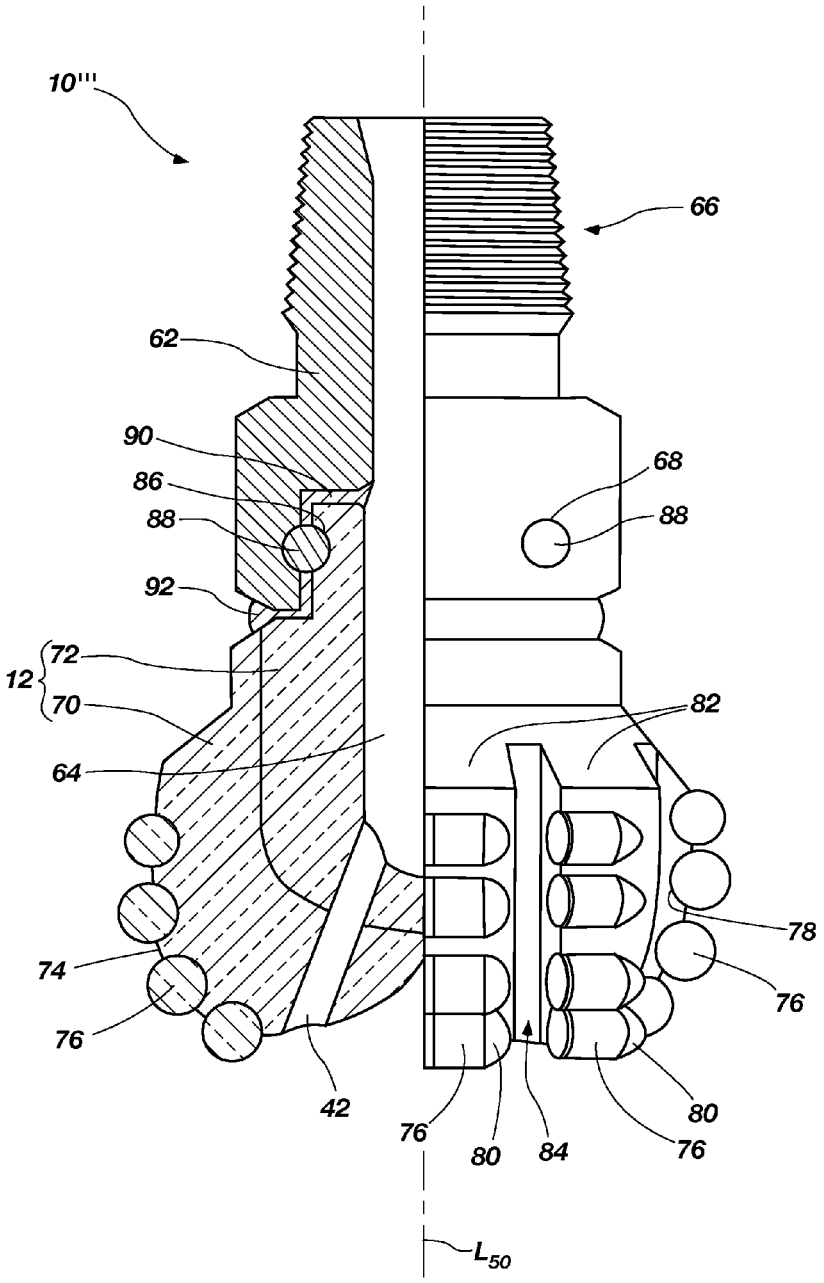
FIG. 7 is a partial cutaway perspective view of another embodiment of a downhole tool for use in a wellbore in a subterranean formation.

Referring to FIG. 7, a partial cutaway perspective view of another embodiment of a downhole tool 10''' for use in a wellbore in a subterranean formation is shown, which includes at least one component comprising an anomalous strengthening material. The downhole tool 10''' may comprise an earth-boring rotary drill bit configured to drill a wellbore in a subterranean formation. Similar earth-boring rotary drill bits and methods of forming such earth-boring rotary drill bits are disclosed in U.S. Pat. No. 7,776,256 B2, issued Aug. 7, 2010, to Smith et al., U.S. Pat. No. 7,802,495 B2, issued Sep. 28, 2010, to Oxford et al., and U.S. Pat. No. 7,913,779 B2, issued Mar. 29, 2011, to Choe et al., the disclosure of each of which is incorporated herein in its entirety by this reference. The downhole tool 10''' has a body 12 configured as a bit body at least partially formed from an anomalous strengthening material. The downhole tool 10''' may also include a shank 62 attached to the bit body 12.

The shank 62 includes a generally cylindrical outer wall having an outer surface and an inner surface. The outer wall of the shank 62 encloses at least a portion of a longitudinal bore 64 that extends through the downhole tool 10'''. At least one surface of the outer wall of the shank 62 may be configured for attachment of the shank 62 to the bit body 12. The shank 62 also may include a male or female API threaded connection portion 66 for attaching the downhole tool 10''' to a drill string (not shown). One or more optional apertures 68 may extend through the outer wall of the shank 62. At least one optional groove 86 may be formed in the bit body 12. Each optional groove 86 may correspond to and be aligned with an optional aperture 68 extending through the outer wall of the shank 62. A retaining member 88 may be provided within each aperture 68 in the shank 62 and each groove 86. Mechanical interference between the shank 62, the retaining member 88, and the bit body 12 may prevent longitudinal separation of the bit body 12 from the shank 62, and may prevent rotation of the bit body 12 about a longitudinal axis $L_{50}$ of the rotary downhole tool 10''' relative to the shank 62.

A brazing material 90 such as, for example, a silver-based or nickel-based metal alloy may be provided in the substantially uniform gap between the shank 62 and the bit body 12. As an alternative to brazing, or in addition to brazing, a weld 92 may be provided around the rotary downhole tool 10''' on an exterior surface thereof along an interface between the bit body 12 and the steel shank 62. The weld 92 and the brazing material 90 may be used to further secure the shank 62 to the bit body 12. In this configuration, if the brazing material 90 in the substantially uniform gap between the shank 62 and the bit body 12 and the weld 92 should fail while the downhole tool 10''' is located at the bottom of a well bore-hole during a drilling operation, the retaining members 88 may prevent longitudinal separation of the bit body 12 from the shank 62, thereby preventing loss of the bit body 12 in the well bore-hole.

In some embodiments, the bit body 12 of the downhole tool 10''' may be substantially formed from and composed of a particle-matrix composite material. At least one of the particles and the matrix, or a portions of at least one of the particles and the matrix, may comprise an anomalous strengthening material. Furthermore, the composition of the particle-matrix composite material may be selectively varied within the bit body 12 to provide various regions within the bit body that have different, custom tailored physical properties or characteristics.

By way of example and not limitation, the bit body 12 may include a first region 70 having a first material composition and a second region 72 having a second, different material composition. The first region 70 may include the longitudinally lower and laterally outward regions of the bit body 12, which are commonly referred to as the "crown" of the bit body 12. The first region 70 may include the face 74 of the bit body 12, which may be configured to carry a plurality of cutting elements, such as PDC cutters 76. For example, a plurality of pockets 78 and buttresses 80 may be provided in or on the face 74 of the bit body 12 for carrying and supporting the PDC cutters 76. Furthermore, a plurality of blades 82 and junk slots 84 may be provided in the first region 70 of the bit body 12. The second region 72 may include the longitudinally upper and laterally inward regions of the bit body 12. The longitudinal bore 64 may extend at least partially through the second region 72 of the bit body 12.

As previously stated, the first region 70 of the bit body 12 may have a first material composition and the second region 72 of the bit body 12 may have a second, different material composition. The first region 70 may include a metal, a metal alloy, or a particle-matrix composite material. The second region 72 of the bit body 12 may include a metal, a metal alloy, or a particle-matrix composite material. By way of example and not limitation, the material composition of the first region 70 may be selected to exhibit higher yield strength at elevated temperatures expected to be encountered during drilling than the material composition of the second region 72. Accordingly, the first region 70 may include a greater volume percentage of anomalous strengthening material than the second region 72 in some embodiments.

In embodiments where the first region 70 comprises a particle-matrix composite material, the particle-matrix composite material of the first region 70 may include a plurality of hard particles dispersed randomly throughout a matrix material. The hard particles may comprise diamond or ceramic materials such as carbides, nitrides, oxides, and borides (including boron carbide ($B_4C$)). More specifically, the hard particles may comprise carbides and borides made from elements such as W, Ti, Mo, Nb, V, Hf, Ta, Cr, Zr, Al, and Si. By way of example and not limitation, materials that may be used to form hard particles include tungsten carbide (WC, $W_2C$), titanium carbide (TiC), tantalum carbide (TaC), titanium diboride ($TiB_2$), chromium carbides, titanium nitride (TiN), vanadium carbide (VC), aluminium oxide ($Al_2O_3$), aluminium nitride (AlN), boron nitride (BN), and silicon carbide (SiC). Furthermore, combinations of different hard particles may be used to tailor the physical properties and characteristics of the particle-matrix composite material. The hard particles may be formed using techniques known to those of ordinary skill in the art. Most suitable materials for hard particles are commercially available and the formation of the remainder is within the ability of one of ordinary skill in the art. The matrix material of the particle-matrix composite material may include an anomalous strengthening material.

The material composition of the second region 72 of the bit body may include, for example, cobalt-based, iron-based, nickel-based, iron and nickel-based, cobalt and nickel-based, iron and cobalt-based, aluminum-based, copper-based, magnesium-based, and titanium-based alloys. The material composition of the second region 72 may also be selected from commercially pure elements such as cobalt, aluminum, copper, magnesium, titanium, iron, and nickel. By way of example and not limitation, the material composition of the second region 72 may include carbon steel, alloy steel, stainless steel, tool steel, Hadfield manganese steel, nickel or cobalt superalloy material, and low thermal expansion iron- or nickel-based alloys such as INVAR®. As used herein, the term "superalloy" refers to an iron-, nickel-, and cobalt-based alloys having at least 12% chromium by weight. Additional exemplary alloys that may be used as material compositions of the second region 72 include austenitic steels, nickel-based superalloys such as INCONEL® 625M or RENÉ™ 95, and INVAR® type alloys. Another exemplary material composition of the second region 72 is a Hadfield austenitic manganese steel (Fe with approximately 12% Mn by weight and 1.1% C by weight). Alternatively, the material composition of the second region 72 of the bit body 12 may include a particle-matrix composite material in which hard particles are randomly dispersed throughout a matrix material. The hard particles and the matrix materials may be selected from those previously described in relation to the hard particles of the first region 70 and the material composition of the second region 72. The material composition of the second region 72 of the bit body 12, however, may be selected to facilitate machining of the second region 72 using conventional machining techniques. Such conventional machining techniques may include, for example, turning, milling, and drilling techniques, which may be used to configure the second region 72 of the bit body 12 for attachment to the shank 62. For example, features such as the grooves 86 may be machined in the second region 72 of the bit body 12 to configure the second region 72 of the bit body 12 for attachment to the shank 62.

In other embodiments, both the first region 70 and the second region 72 of the bit body 12 may be substantially formed from and composed of the same metal, metal alloy, or particle-matrix composite material. In such embodiments, at least a portion of the first region 70 and the second region 72 may be formed from an anomalous strengthening material. In some embodiments, other components of the downhole tool 10''' may at least partially formed from an anomalous strengthening material. For example, one, some, or all of the shank 62, the retaining members 88, and the cutters 76 may be partially or completely formed from an anomalous strengthening material. By forming the body 12 of the downhole tool 10''', other components of the downhole tool 10''', or both at least partially from an anomalous strengthening material, the downhole tool 10''' may require less derating with increasing temperature, may not require any derating with increasing temperature, and may even enable increased torque and WOB to be applied with increasing temperature, at least within the range of temperatures over which the anomalous strengthening material increases in yield strength with increasing temperature.

While certain illustrative embodiments have been described in connection with the figures, those of ordinary skill in the art will recognize and appreciate that embodiments of the invention are not limited to those embodiments explicitly shown and described herein. Rather, many additions, deletions, and modifications to the embodiments described herein may be made without departing from the scope of embodiments of the invention as hereinafter claimed, including legal equivalents. In addition, features from one embodiment may be combined with features of another embodiment while still being encompassed within the scope of embodiments of the invention as contemplated by the inventor.

What is claimed is:

1. A downhole tool for use in a wellbore in a subterranean formation, comprising:

a body comprising a composite material comprising:

at least one region of at least one anomalous strengthening material; and at least another region of at least one temperature weakening material abutting the at least one region of the at least one anomalous strengthening material;

wherein a quantity of the at least one anomalous strengthening material and a quantity of the at least one temperature weakening material are such that a yield strength of the body is at least substantially constant as a function of temperature from about 120° C. to about 150° C.

2. The downhole tool of claim 1, wherein the at least one anomalous strengthening material exhibits increasing yield strength with increasing temperature from about 120° C. to about 150° C.

3. The downhole tool of claim 2, wherein the at least one anomalous strengthening material exhibits increasing yield strength with increasing temperature from about 110° C. to about 200° C.

4. The downhole tool of claim 1, wherein the at least one anomalous strengthening material comprises an alloy of at least two different elements, and at least one element of the at least two different elements has a different natural crystalline structure from a natural crystalline structure of at least another element of the at least two different elements.

5. The downhole tool of claim 1, wherein the downhole tool comprises a fluid passageway through the downhole tool and a threaded connection located on at least one end of the downhole tool.

6. The downhole tool of claim 1, wherein the yield strength of the body is at least substantially constant as a function of temperature from about 110° C. to about 200° C.

7. The downhole tool of claim 1, wherein the composite material of the body comprises a matrix phase of the at least one anomalous strengthening material and a discontinuous phase of the at least one temperature weakening material interspersed within the matrix phase.

8. The downhole tool of claim 1, wherein the at least one anomalous strengthening material comprises at least one material selected from the group consisting of $Ni_3Al$, $Ni_3V$, $Ni_3Ga$, $Ni_3Si$, $Ni_3Ge$, $Fe_3Al$, FeAl, $Fe_3Ga$, $Fe_3V$, FeCo, $Fe_3Be$, β-CuZn, $Cu_3Au$, $Co_3Ti$, $Co_3V$, $Pt_3Ti$, $Ag_2MgZn$, TiAl, $Mg_3Cd$, $Mn_3Sn$, and a refractory metal disilicide.

9. The downhole tool of claim 1, wherein the composite material of the body comprises alternating layers of the at least one anomalous strengthening material and the at least one temperature weakening material.

10. A method of forming a downhole tool for use in a wellbore in a subterranean formation, comprising:

forming a body comprising a composite material including at least one region of at least one anomalous strengthening material, and at least another region of at least one temperature weakening material abutting the at least one region of the at least one anomalous strengthening material; and selecting a quantity of the at least one anomalous strengthening material and a quantity of the at least one temperature weakening material to be such that a yield strength of the body is at least substantially constant as a function of temperature from about 120° C. to about 150° C.

11. The method of claim 10, further comprising selecting the at least one anomalous strengthening material to exhibit increasing yield strength with increasing temperature from about 120° C. to about 150° C.

12. The method of claim 11, further comprising selecting the at least one anomalous strengthening material to exhibit increasing yield strength with increasing temperature from about 110° C. to about 200° C.

13. The method of claim 11, further comprising selecting the downhole tool to include a fluid passageway extending through the downhole tool and a threaded connection located on at least one end of the downhole tool.

14. The method of claim 10, further comprising forming the body to comprise the at least one anomalous strengthening material, wherein the yield strength of the body is at least substantially constant as a function of temperature from about 110° C. to about 200° C.

15. The method of claim 10, further comprising selecting the at least one anomalous strengthening material to comprise an alloy including at least two different elements, at least one element of the at least two different elements having a different natural crystalline structure from a natural crystalline structure of at least another element of the at least two different elements.

16. The method of claim 10, further comprising selecting the at least one anomalous strengthening material to comprise one or more of $Ni_3Al$, $Ni_3V$, $Ni_3Ga$, $Ni_3Si$, $Ni_3Ge$, $Fe_3Al$, FeAl, $Fe_3Ga$, $Fe_3V$, FeCo, $Fe_3Be$, β-CuZn, $Cu_3Au$, $Co_3Ti$, $Co_3V$, $Pt_3Ti$, $Ag_2MgZn$, TiAl, $Mg_3Cd$, $Mn_3Sn$, and a refractory metal disilicide.

17. A method of using a downhole tool in a wellbore in a subterranean formation, comprising:

disposing a body comprising a composite material including at least one region of at least one anomalous strengthening material, and at least another region of at least one temperature weakening material abutting the at least one region of the at least one anomalous strengthening material in a wellbore in a subterranean formation, wherein a quantity of the at least one anomalous strengthening material and a quantity of the at least one temperature weakening material are such that a yield strength of the body is at least substantially constant as a function of temperature from about 120° C. to about 150° C.;

exposing the at least one anomalous strengthening material to a temperature within the wellbore higher than a temperature at a surface of the subterranean formation and increasing a yield strength of the at least one anomalous strengthening material.

18. The method of claim 17, further comprising selecting the at least one anomalous strengthening material to exhibit increasing yield strength with increasing temperature from about 120° C. to about 150° C.

19. The method of claim 18, further comprising selecting the at least one anomalous strengthening material to exhibit increasing yield strength with increasing temperature from about 110° C. to about 200° C.

20. The method of claim 17, further comprising forming the body to exhibit an at least substantially constant yield strength as a function of temperature from about 110° C. to about 200° C.

* * * * *